US005196897A

United States Patent [19]

Trask

[11] Patent Number: 5,196,897

[45] Date of Patent: Mar. 23, 1993

[54] HIGH SPEED DUPLEX PRINTING MECHANISM HAVING PLURAL REVERSING PATHWAYS

[75] Inventor: Jeffrey L. Trask, Boise, Id.

[73] Assignee: Hewlett-Packard Company, Palo Alto, Calif.

[21] Appl. No.: 731,844

[22] Filed: Jul. 16, 1991

[51] Int. Cl.[5] ..... G03G 21/00

[52] U.S. Cl. ..... 355/319; 271/186; 271/304; 355/308

[58] Field of Search ..... 355/308, 309, 318, 319, 355/321; 271/184, 186, 303, 304

[56] References Cited

U.S. PATENT DOCUMENTS

| | | | |
|---|---|---|---|
| 4,202,621 | 5/1980 | Yashimura et al. | 355/311 |
| 4,385,825 | 5/1983 | Kaneko | 355/319 |
| 4,692,020 | 9/1987 | Tsujihara | 355/319 |
| 4,806,979 | 2/1989 | Tokoro et al. | 355/319 |
| 5,049,947 | 9/1991 | Fish et al. | 355/318 |
| 5,077,585 | 12/1991 | Watanabe et al. | 355/321 |

*Primary Examiner*—Fred L. Braun

[57] ABSTRACT

A printer produces single and double sided images in correct page order using identically oriented sheets. An imprinting path is provided with mechanisms for transferring an image to one side of the sheet. The printer also has a sheet side reversing path that communicates with the imprinting path, and an output path. The printer includes first and second direction reversing paths that communicate with the imprinting path, the first direction reversing path further communicating with the sheet-side reversing path and the second direction reversing path communicating with the output path. A path selection apparatus is operable, when the printer is to imprint a double-sided image, to direct a sheet initially to the first direction reversing path after an image has been imprinted on one side thereof, and to direct the sheet to a second path after a second image has been imprinted on a second side thereof, whereby the sheet is directed to the output path after the second imprinting operation.

8 Claims, 13 Drawing Sheets

HIGH SPEED DUPLEX PRINTING MECHANISM HAVING PLURAL REVERSING PATHWAYS

FIELD OF THE INVENTION

This invention relates to printing mechanisms and, more particularly, to printing mechanisms that can automatically produce images on both sides of a media sheet.

BACKGROUND OF THE INVENTION

Many copiers and printers have the ability to imprint images on media sheets using either a simplex or duplex process. A simplex process is one wherein an image is applied to only a single side of a media sheet being fed through the apparatus, while a duplex process prints images on both sides of the media sheet. Hereafter, the prior art and the invention will be described in the context of a laser printer. However, it is to be understood that it is equally applicable to any system that employs duplex imprinting processes.

Printers which provide duplex imprinting often require highly complex media sheet movement mechanisms to enable both sides of the sheet to be presented to the image exposure system. Such duplex mechanisms require additional space within the printer's covers, create a delay in the print process, and often add considerable expense to the printer mechanism. One of the more advanced printer mechanisms that overcomes many of these drawbacks is the LaserJet series of printers produced by the Assignee of this patent application. As the duplex printing mechanisms incorporated in the LaserJet series of printers are relevant prior art to this invention, their details will be described in conjunction with FIGS. 1-6 hereof.

FIG. 1 shows a schematic side view of a media sheet which will be used to diagram the duplex processes in both the prior art and the invention. The semicircle indicates the top, front side of a media sheet (this is where a letterhead would normally be located). The box indicates the bottom, backside of the media sheet. This is the side of the paper on which the duplex image is printed. A number in either the semicircle or the box indicates the page number which has been or is being printed on that side of the media sheet. An arrow in the middle of the sheet symbol indicates the direction in which the sheet is moving.

FIG. 2 shows a side schematic view of a laser printer 10 which is capable of simplex print operations. Control of laser printer 10 is achieved by microprocessor 11, which receives print orders and data from a connected computer (not shown). Laser printer 10 is provided with two paper feed trays, a multipurpose tray 12, and a larger capacity feed tray 14. Media sheets in multipurpose (MP) tray 12 are oriented as shown by sheet schematic 16 with the letterhead side up and facing closest to the printer inlet. In feed tray 14, media sheets 18 are oriented letterhead side down and arranged so that the letterhead end is closest to input feed roller 20. Depending upon which paper tray is being utilized (either MP tray 12 or feed tray 14), a media sheet will be grabbed by either MP roller 19 or feed roller 20 and passed through a series of rollers 22 into an imprinting path 24.

In the well known manner, a photoconductive (PC) drum 26 is imaged by a laser/scanning system 28. When a media sheet passes between photoconductor drum 26 and transfer roller 30, the media sheet attains a toned image from PC drum 26. From there the sheet passes along imprinting path 24 into a fuser mechanism 32 where the image is fixed, again in the known manner. When the media sheet exits from fuser mechanism 32, it is directed by a simplex/duplex select bar 34 into an output path 36 where it passes between output rollers 38 into an output tray 40. Since the laser printer shown in FIG. 2 has no duplex capability, simplex/duplex select arm 34 is maintained in the position shown in FIG. 2 at all times.

As can be seen from the schematics of the print sheets shown in FIG. 2, feed tray 14 is utilized to provide media sheets for printing. Each page is printed serially and the pages feed, in seriatim, through imprinting path 24 and output path 36 where they exit onto feed tray 40 in page order number, and in a face-down orientation.

Turning now to FIGS. 3-6, a duplexing mechanism 50 employed with the laser printer of FIG. 2 is illustrated. Duplexing mechanism 50 includes a reversing roller 52 and a slave roller 54 that are, respectively, positioned on either side of a reversing path 56. An imprinting path extension 24' communicates with imprinting path 24 within laser printer 10 and is opened when simplex/duplex select lever is in the position shown in FIG. 3. When in that position, select lever 34 closes off output pathway 36 thereby preventing a media sheet from exiting the copier during the duplex printing portion of a print cycle.

Reversing path 56 extends vertically downward to a lower portion of duplexing mechanism 50 where additional duplex transport rollers 58 capture the media sheet and feed it up through additional feed rollers 60, opening 62 and back into imprinting path 24.

The reversing action of duplexer 50 is controlled by an optical sensor 64 which is positioned immediately below reversing roller 52. Optical senso·· 64 detects the end of a media sheet as it is fed vertically upward by reversing roller 52. At that point, a signal from optical sensor 64 causes a reversal of the rotation of reversing roller 52 which sends the media sheet downward along duplex path 56, etc.

In FIG. 4, a timing diagram is illustrated for the prior art duplexing system shown in FIGS. 3 and 5, 6. As will be hereinafter seen, even numbered pages (i.e. backsides) are printed first to preserve proper page order in the output tray. The horizontal axis of the chart of FIG. 4 indicates increments of time and each line of the chart indicates a specified station in the laser printer, and the numbers above each line indicate when the page bearing that number arrives at the station. For instance, the first line of the chart of FIG. 4 indicates that the pages are received serially from a connected computer (not shown). Note that no printing action is commenced at PC drum 26 until both pages 1 and 2 are stored in memory, at which time, page two is printed first. As is shown by dashed line 80, page two then proceeds through reversing roller 52 and passes into the lower portion of duplexer mechanism 50. The sheet bearing page two is then transported past PC drum 26 to enable page one to be printed on its front side. The duplex-printed media sheet bearing pages one and two is then passed to output roller 38 where it exits onto output tray 40 and is released from memory.

The prior art duplex printing operation will now be described in conjunction with FIGS. 3 and 5-7. It is assumed that large capacity feed tray 14 is being used to feed media sheets into the duplex printing mechanism. As can be seen in FIG. 3, page two has already been printed and is being passed upwardly between reversing roller 52 and slave roller 54 in duplexing path 56. It will be noted that the orientations of the media sheets in MP tray 12 and feed tray 14 must be "flipped" by the user in order to allow the duplex printing operation to output the media sheets in page number order.

In FIG. 5, the sheet bearing page two has already passed down through reversing path 56, rollers 58 and 60, and is being fed upwardly through opening 62 into imprinting path 24 to enable page one to be imprinted thereupon. Additionally, page four has already been printed on a second media sheet, which sheet is being directed upwardly between reversing roller 52 and slave roller 54.

In FIG. 6, the next stage of operation is shown wherein simplex/duplex select arm 34 has been pivoted clockwise to open output path 36 to the media sheet bearing pages one and two as it exits from fuser 32. At this stage, the sheet bearing page four resides in the lower portion of duplexer 50 awaiting the printing of a next even page (page 6) on a sheet presently in imprinting pathway 24.

In FIG. 7, the next stage of operation is shown wherein the sheet bearing page six has been allowed to enter duplexing path 56 as a result of switching of simplex/duplex select arm 34. Additionally, the sheet bearing page four has been passed into imprinting path 24 so as to enable page three to be imprinted on its front side. After the sheet bearing page six passes out of fuser 32 and clears simplex/duplex select arm 34, that arm is switched so as to open output path 36, to enable the sheet bearing pages three and four, when it exits from fuser 32, to pass into output path 36. The process continues (as shown in the chart of FIG. 4) until all eight pages have been imprinted and outputted.

As above indicated, in order for the media sheets to be passed to output tray 40 in page order, it is required that the arrangement of sheets that feed laser printer 10 be altered. Often, a user will forget to reorientate the pages and will thereby not achieve the desired letterhead/page numbering arrangement when using the simplex process.

Accordingly, it is an object of this invention to provide a duplexing mechanism for an image imprinter that enables common sheet orientations to be used, whether the imprinting mechanism is employed for simplex or duplex operation.

It is a further object of this invention to provide an improved duplexing mechanism for a laser printer that does not extend print time as a result of its operation.

It is yet another object of this invention to provide an improved duplexing mechanism for a laser printer which employs minimum added apparatus to enable simplex/duplex printing to occur without requiring reorienting of media sheets.

SUMMARY OF THE INVENTION

An apparatus is described for producing images on media sheets wherein the sheets are identically oriented whether single or double sided image imprinting occurs. The apparatus includes an imprinting path with imprinting mechanisms for transferring an image to one side of the sheet. The apparatus further includes a sheet side reversing path that communicates with the imprinting path, and an output path. The apparatus comprises first and second direction reversing paths that communicate with the imprinting path, the first direction reversing path further communicating with the sheet-side reversing path and the second direction reversing path communicating with the output path. A path selection apparatus is operable, when the apparatus is to imprint a double-sided image, to direct a media sheet initially to the first direction reversing path after an image has been imprinted on one side thereof, and to direct the media sheet to a second path after a second image has been imprinted on a second side thereof, whereby the sheet is directed to the output path after the second imprinting operation.

DETAILED DESCRIPTION OF THE INVENTION

Figure 1:
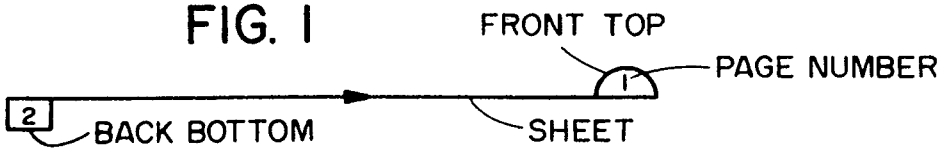
FIG. 1 is a schematic view of a media sheet that indicates both the front and rear of the sheet as well as its top and bottom.
Figure 2:
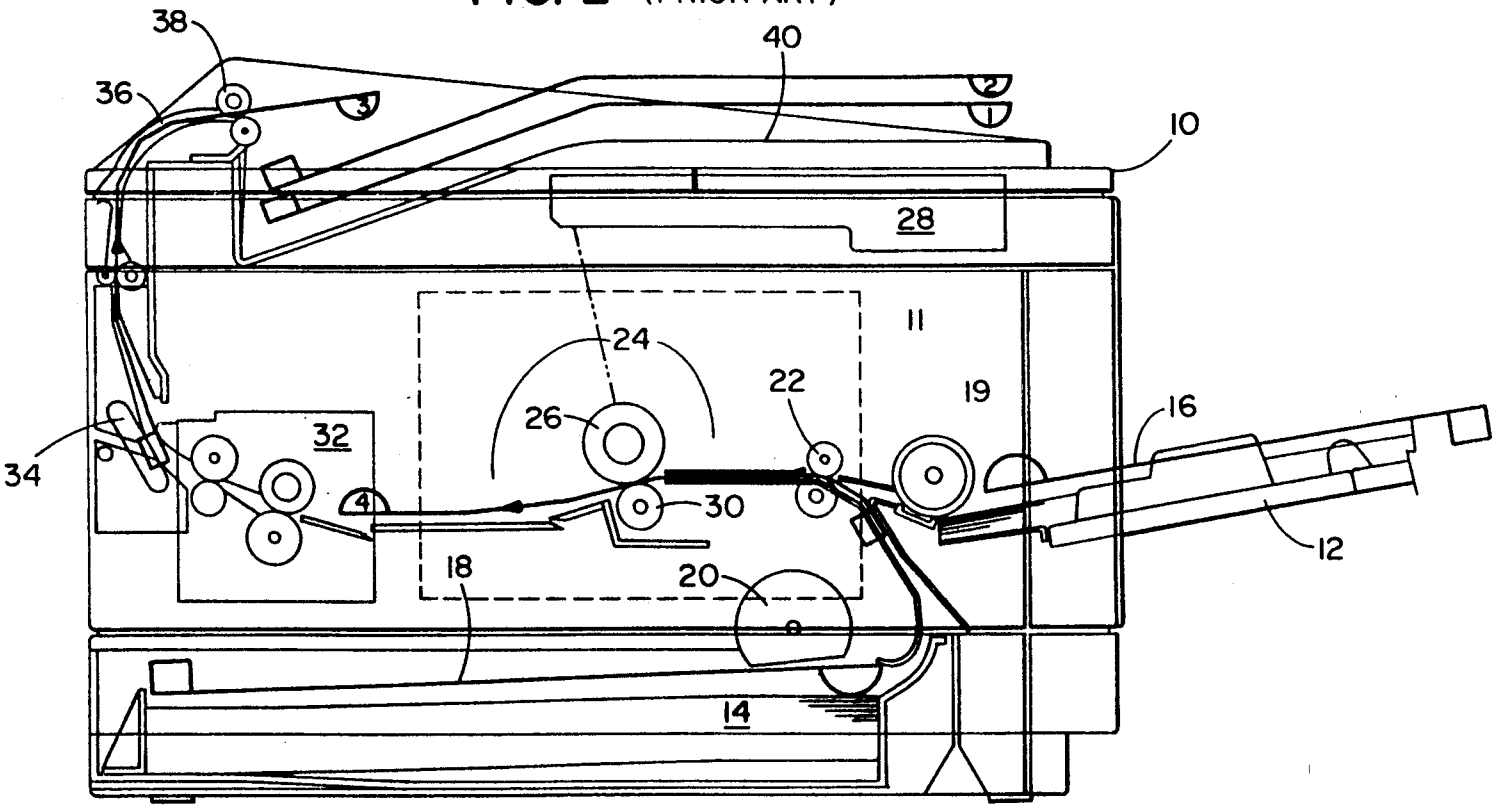
FIG. 2 (PRIOR ART)
FIG. 2 is a side schematic view of a prior art laser printer adapted for simplex printing.
Figure 3:
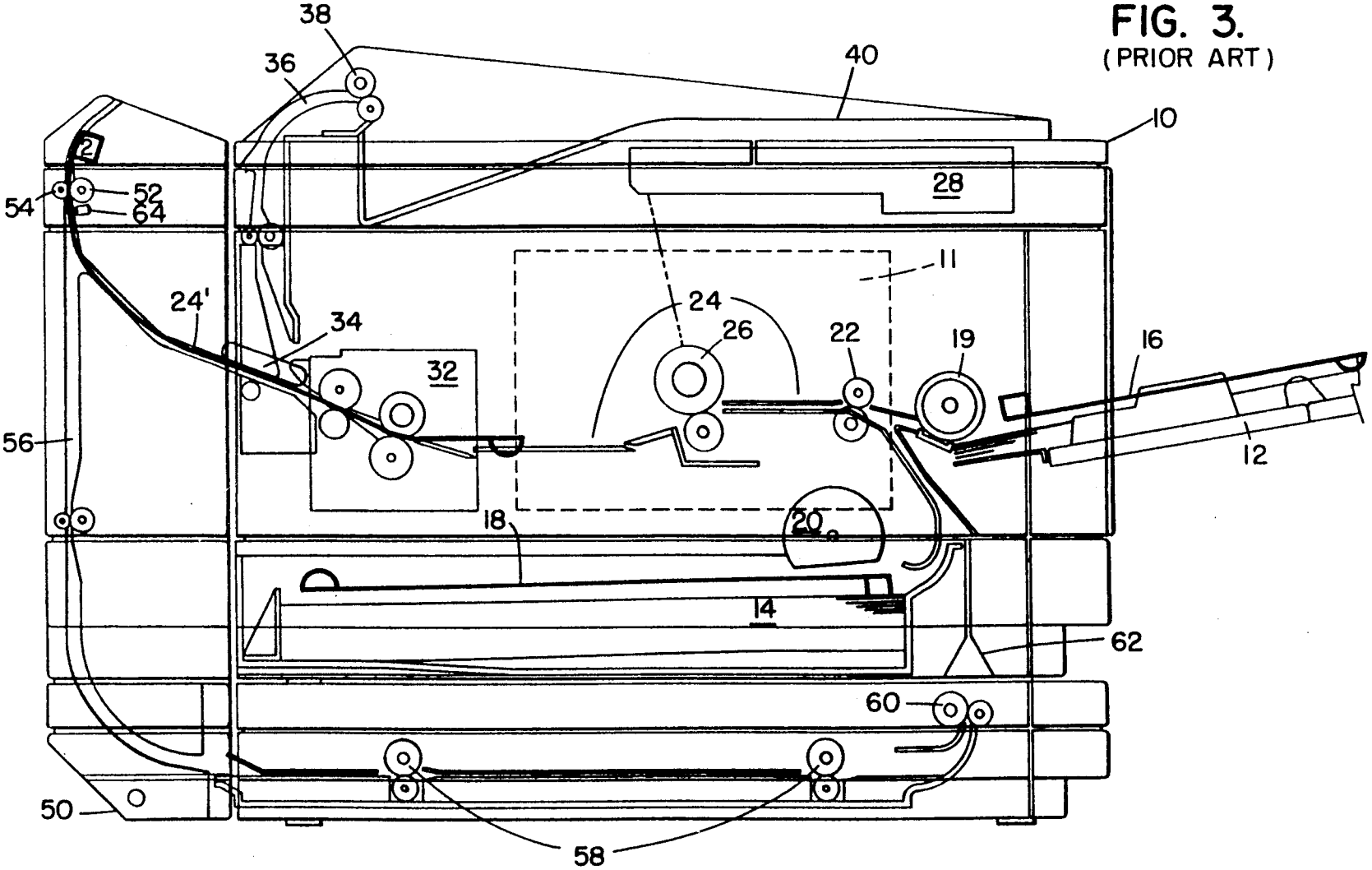
FIG. 3. (PRIOR ART)
FIG. 3 is a side schematic view of the printer of FIG. 2, with a prior art duplexing mechanism attached.

As will be seen from the forthcoming description, the invention entails the provision of an additional set of slave rollers 104 in conjunction with reversing roller 52, a solenoid-actuated duplex-output select arm 106, a gravity-actuated direction changer 108 and an additional output paper path 36' from reversing roller 52 to output roller 38. These additions allow odd pages (front sides) to be printed first so that media sheets do not have to be reoriented in the paper trays prior to duplex printing. In addition, the control of the various rollers/arms/levers, as operated by microprocessor 11, is also altered to enable the new page sequence to be achieved.

Figure 8:
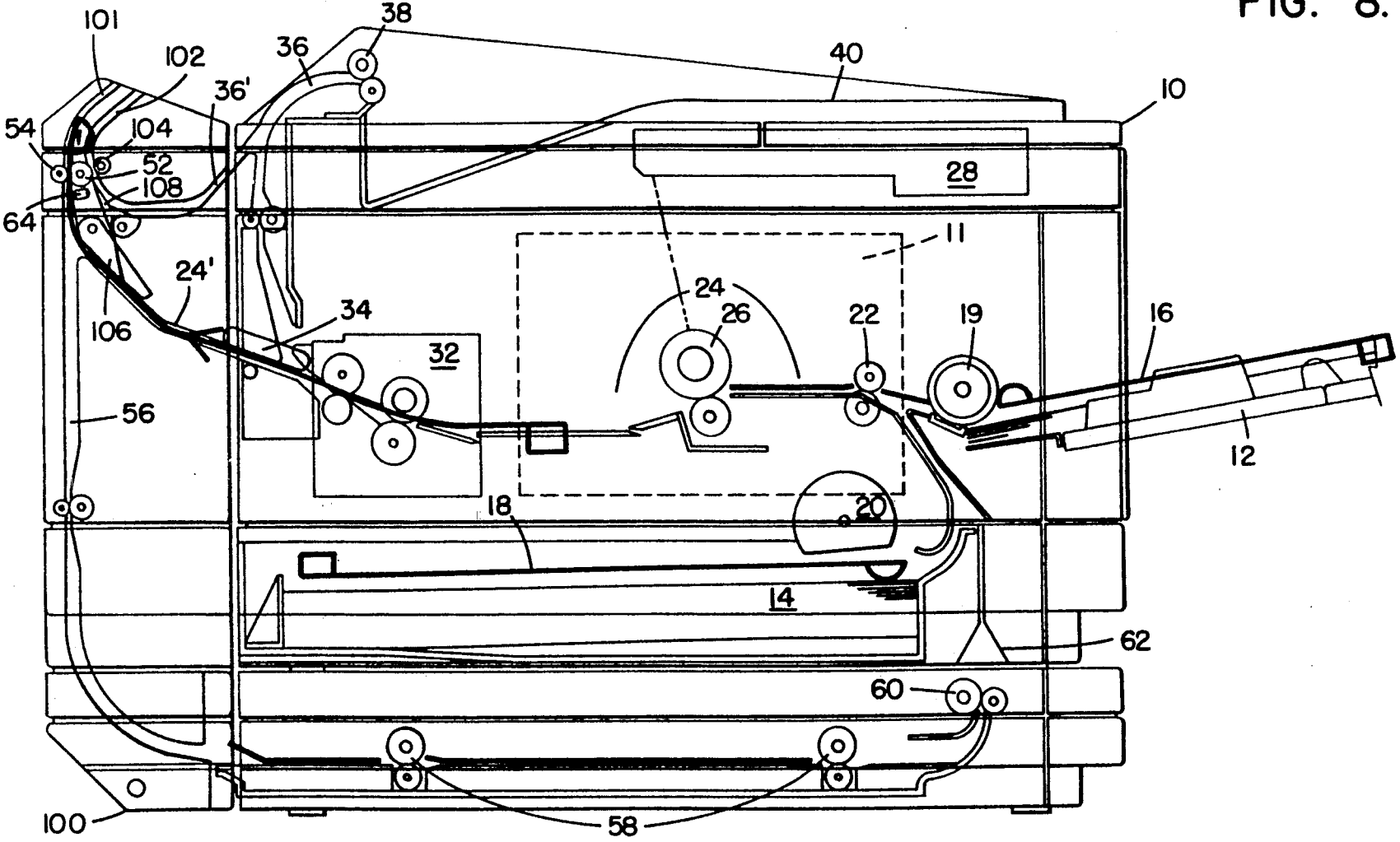
FIG. 8 is a side schematic view of a laser printer in combination with a duplexing mechanism that incorporates the invention hereof.

In FIG. 8, improved duplexing mechanism 100 includes a first reversing path 101 and a second reversing path 102 that is encompassed by reversing roller 52 and a new slave roller 104. A duplex/output select arm 106 is solenoid-operated (not shown) and is clockwise and counterclockwise movable to a media sheet in path 24' to enter either first reversing path 101 or second reversing path 102, as the case may be. In addition, a direction changer arm 108 is pivoted and is pushed out of the way when a media sheet passes upwardly into second reversing path 102. When the end of the media sheet passes the tip of direction changer arm 108, it is impelled by gravity to rotate in a counterclockwise direction thereby opening output path 36' so that when reversing roller 52 reverses, the media sheet enters output path 36, and exits onto output tray 40. In other respects, the laser printer mechanism is identical to the prior art printer described above.

Figure 4:
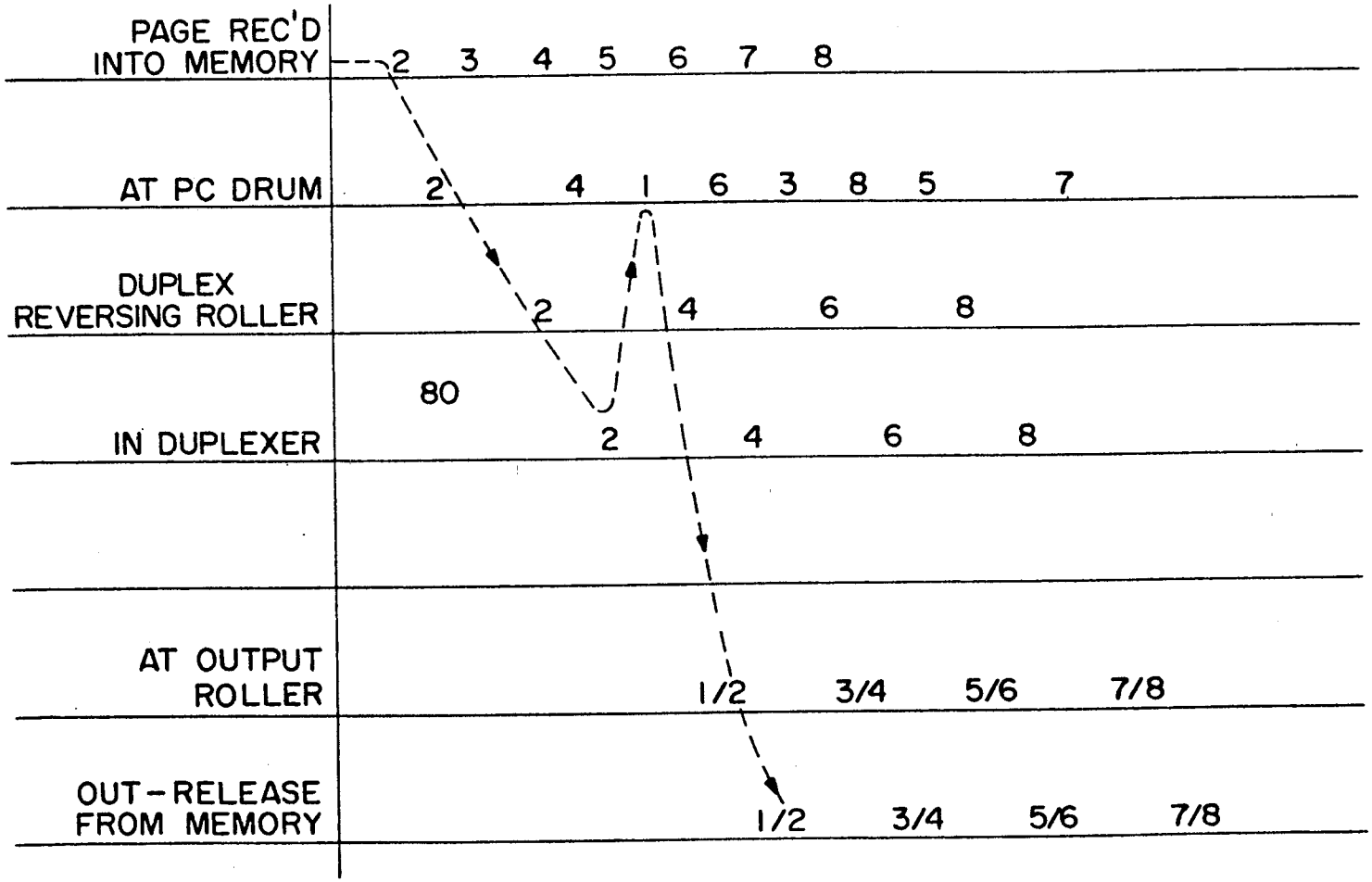
FIG. 4 is a timing diagram helpful in understanding the operation of the printer shown in FIGS. 3 and 5–7.
Figure 5:
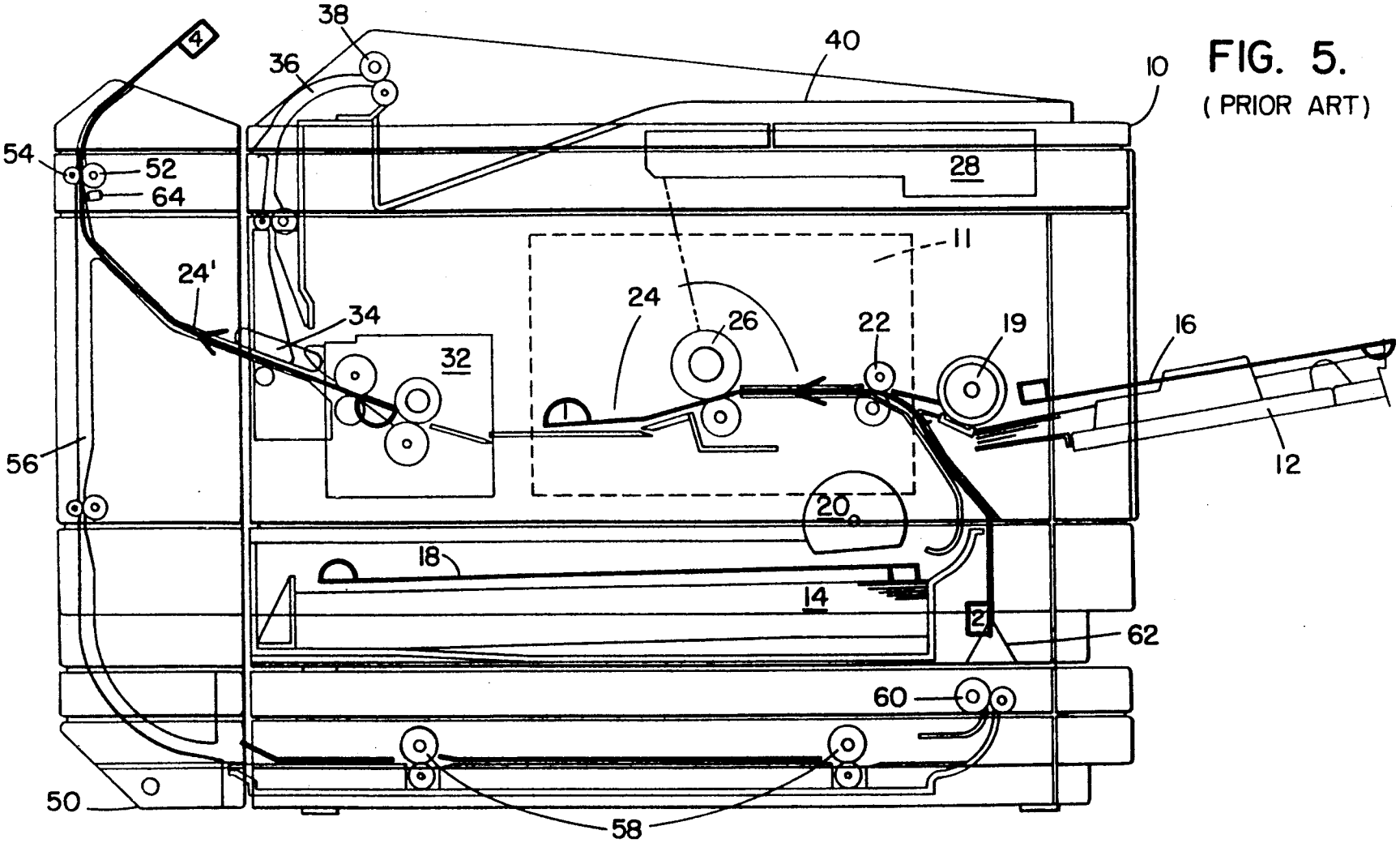
FIG. 5. (PRIOR ART)
FIG. 5 is the printer shown in FIG. 3 at a further point in its operation.
Figure 6:
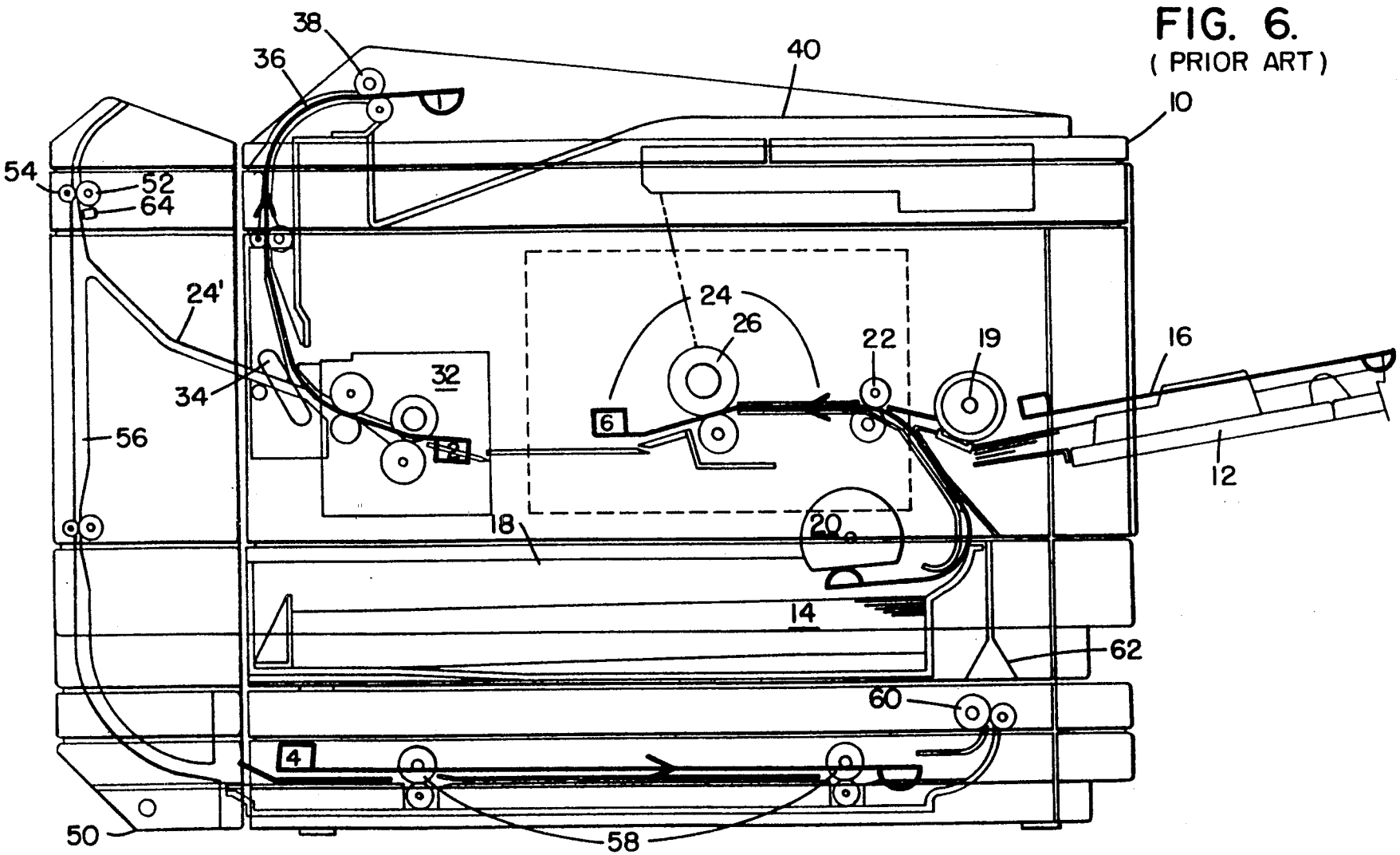
FIG. 6. (PRIOR ART)
FIG. 6 is the printer shown in FIG. 5 at a further point in its operation.
Figure 7:
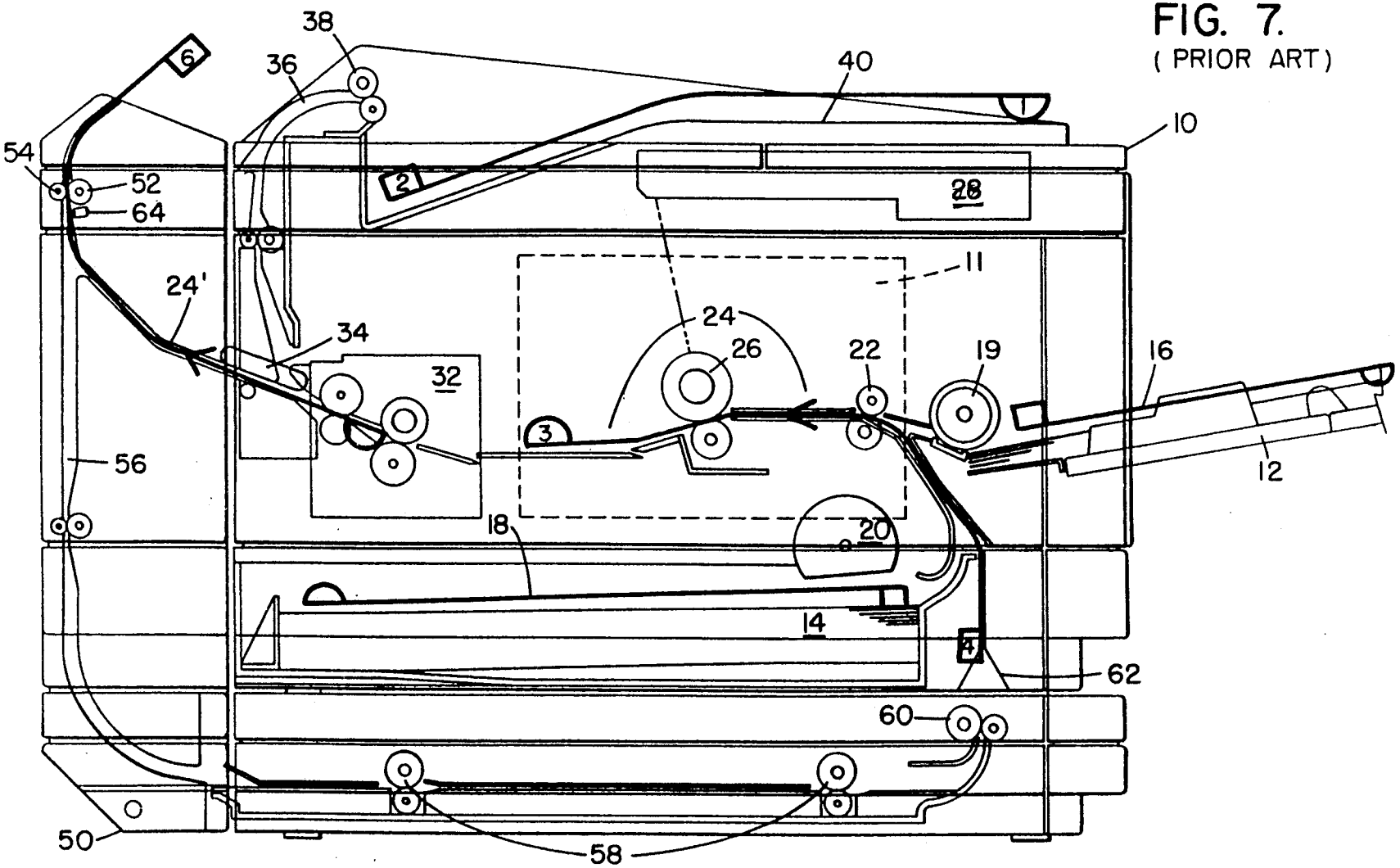
FIG. 7. (PRIOR ART)
FIG. 7 is the printer of FIG. 6 at a further point in its operation.
Figure 9:
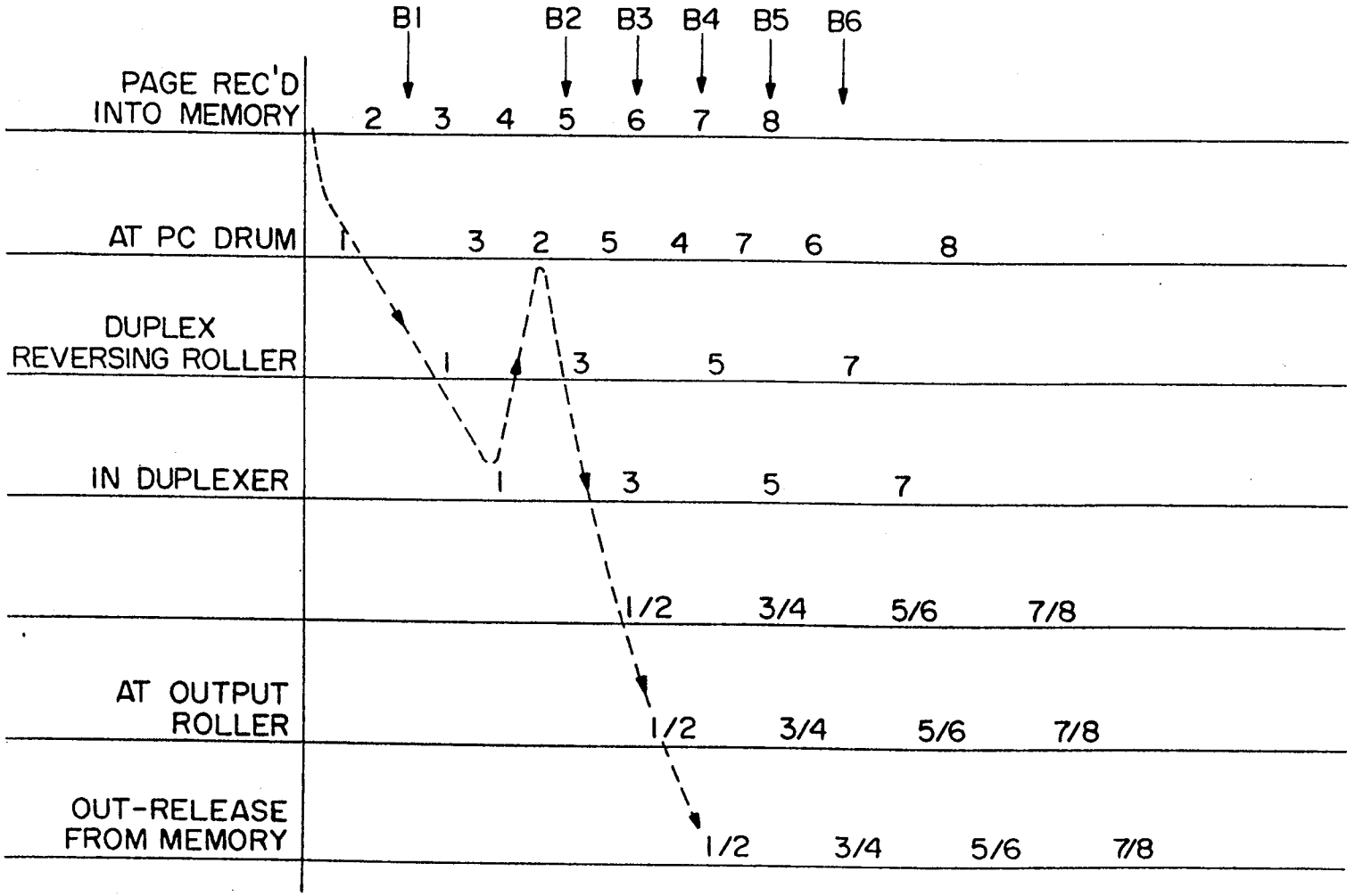
FIG. 9 is a timing diagram helpful in understanding the operation of the printer shown in FIGS. 8 and 10–14.

In FIG. 9, a chart (similar to the chart shown in FIG. 4) illustrates the page and sheet flow in the improved laser printer shown in FIGS. 8 and 10–14. Dotted line 112 indicates that as soon as page one is received into memory of microprocessor 11, printing action commences. Once page one is printed, the media sheet enters the duplexing mechanism and then proceeds to have page two imprinted on the back side of the sheet. As can be seen from an examination of the entries on each of the horizontal lines of FIG. 9, it can be seen that printing occurs with odd pages printed first and even pages second, in sequence. Times B1–B6 indicate specific times during the operation of the printer where "snapshots" are taken and illustrated in FIGS. 8 and 10–14.

Returning now to FIG. 8 and FIGS. 10–14, the operation of laser printer 10 will be described. Note from FIG. 8 that trays 12 and 14 are identically loaded for duplex printing and simplex printing. The print sequence starts with simplex/duplex select arm 34 set to duplex and reversing roller 52 rotating clockwise. Page one has already been printed and is being drawn between reversing roller 52 and slave roller 54. An optical sensor 110 is adapted to sense paper passing between either reversing roller 52 and slave roller 54 or reversing roller 52 and slave roller 104. In either case, it provides a signal to microprocessor 11 when it senses the end of a media sheet.

Figure 10:
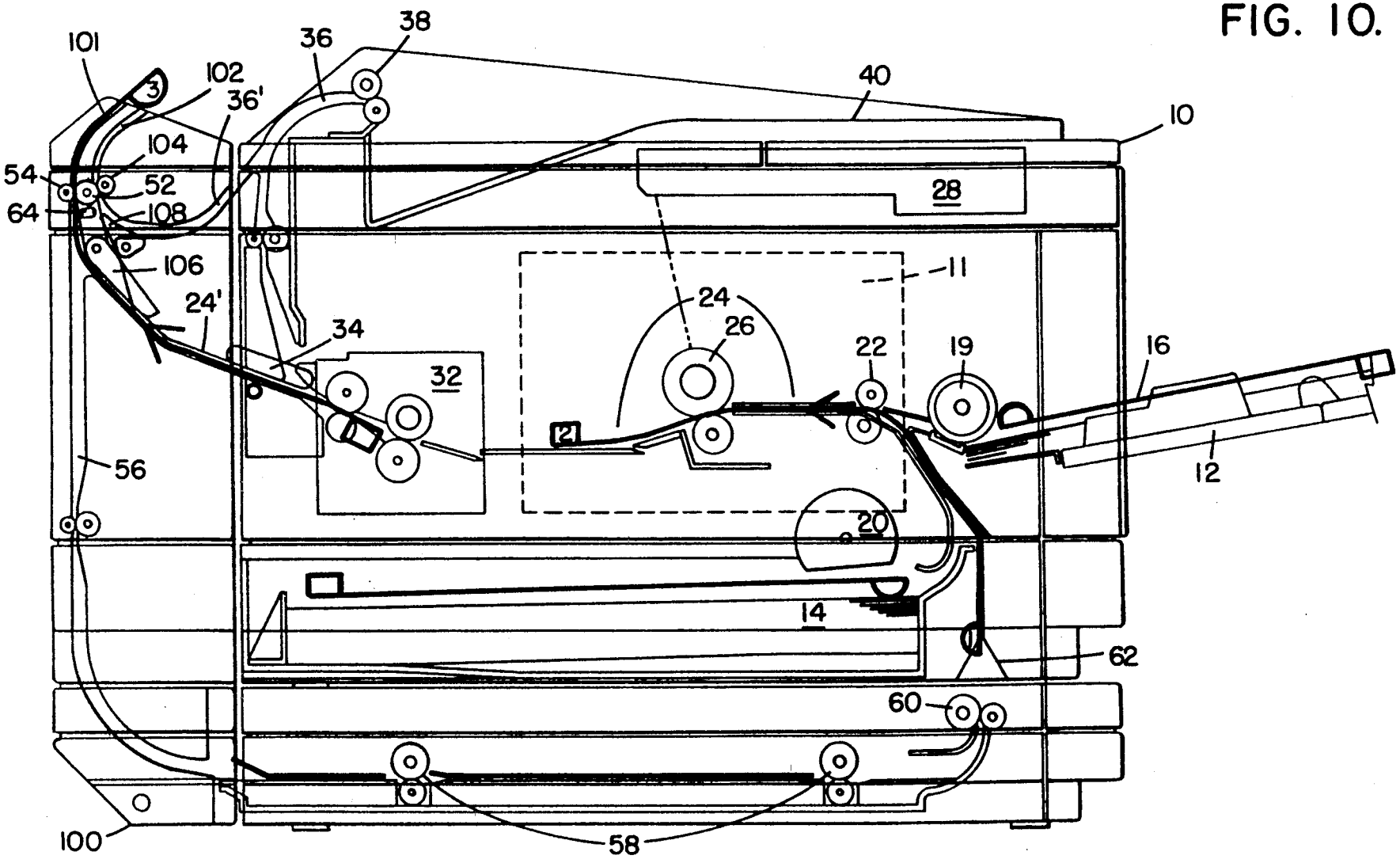
FIGS. 10–14 show the printer of FIG. 8 at various stages during the duplex imprinting of a plurality of media sheets.

When optical sensor 110 detects the end of a media sheet, it provides a signal to microprocessor 11 that causes the direction of reversing roller 52 to be reversed (in this case, to the counterclockwise direction). The media sheet bearing page one is then moved downward in duplexing path 56. FIG. 10 shows a snapshot of the printer's operation at time B2. A one page cycle delay is necessary between the first two media sheets so that they do not collide in reversing roller 52. Thus, page three is printed while the sheet bearing page one resides in the lower portion of duplexing mechanism 100.

Once page three has been printed, it enters the duplexing mechanism (as shown in FIG. 10), followed by the media sheet bearing page one, which is now having page two imprinted thereon. When the end of the media sheet bearing page three is detected by optical sensor 110, reversing roller 52 reverses to the counterclockwise direction and duplex/output select arm 106 is switched to the output position thereby opening reversing pathway 102 (see B3 in FIG. 9). This action allows the media sheet bearing pages one and two to be drawn into reversing path 102 at the same time that the media sheet bearing page three is travelling down into duplexing mechanism 100. Thus, there is a length of time when the media sheet bearing pages one and two and media sheet bearing page three are both being acted upon by reversing roller 52 but on opposite sides thereof. However, the arrangement of slave rollers 54 and 104 avoids the need for an additional driven roller for reversing of media sheets prior to their being fed to output roller 38.

Figure 11:
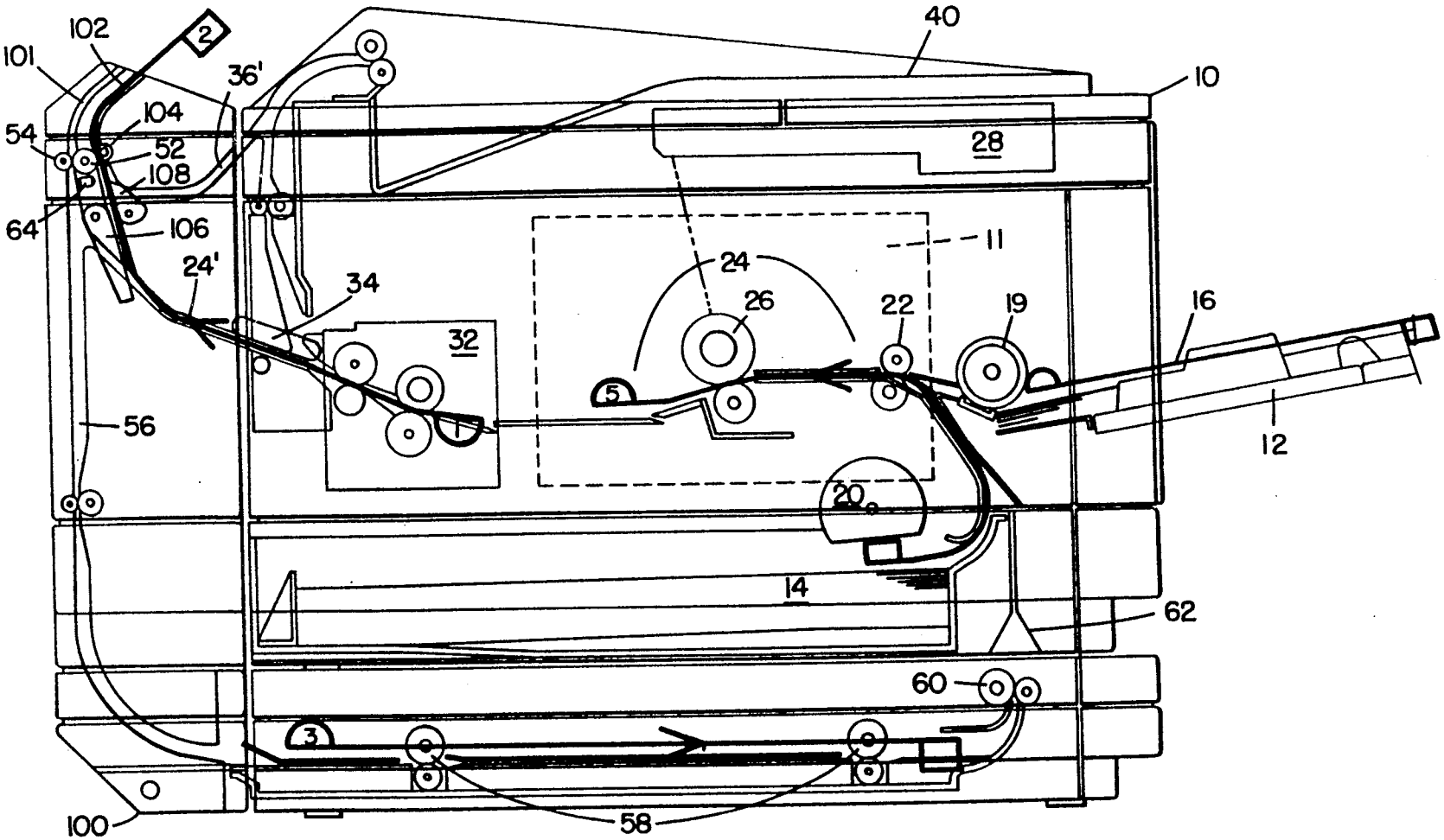
Figure 12:
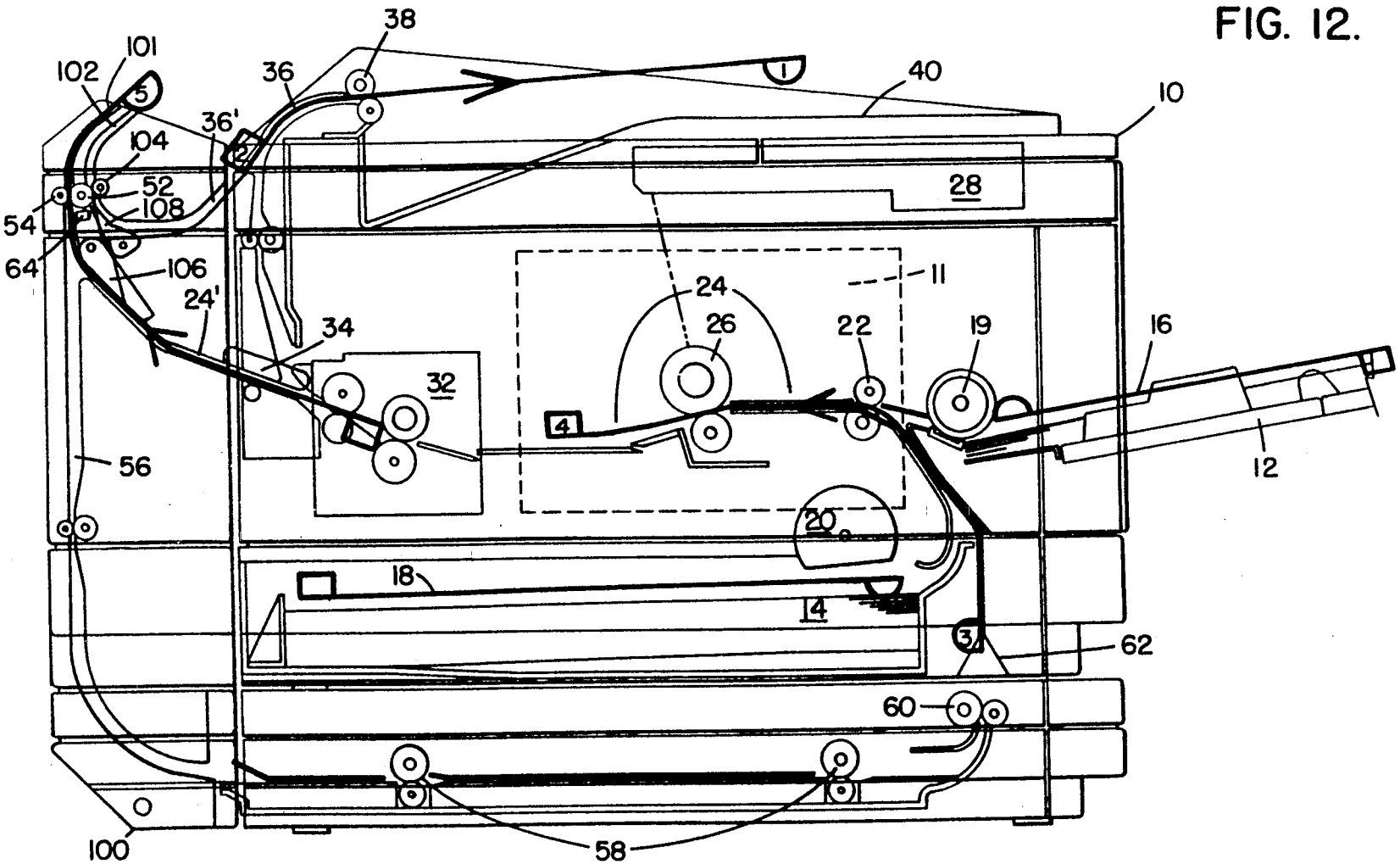
Figure 13:
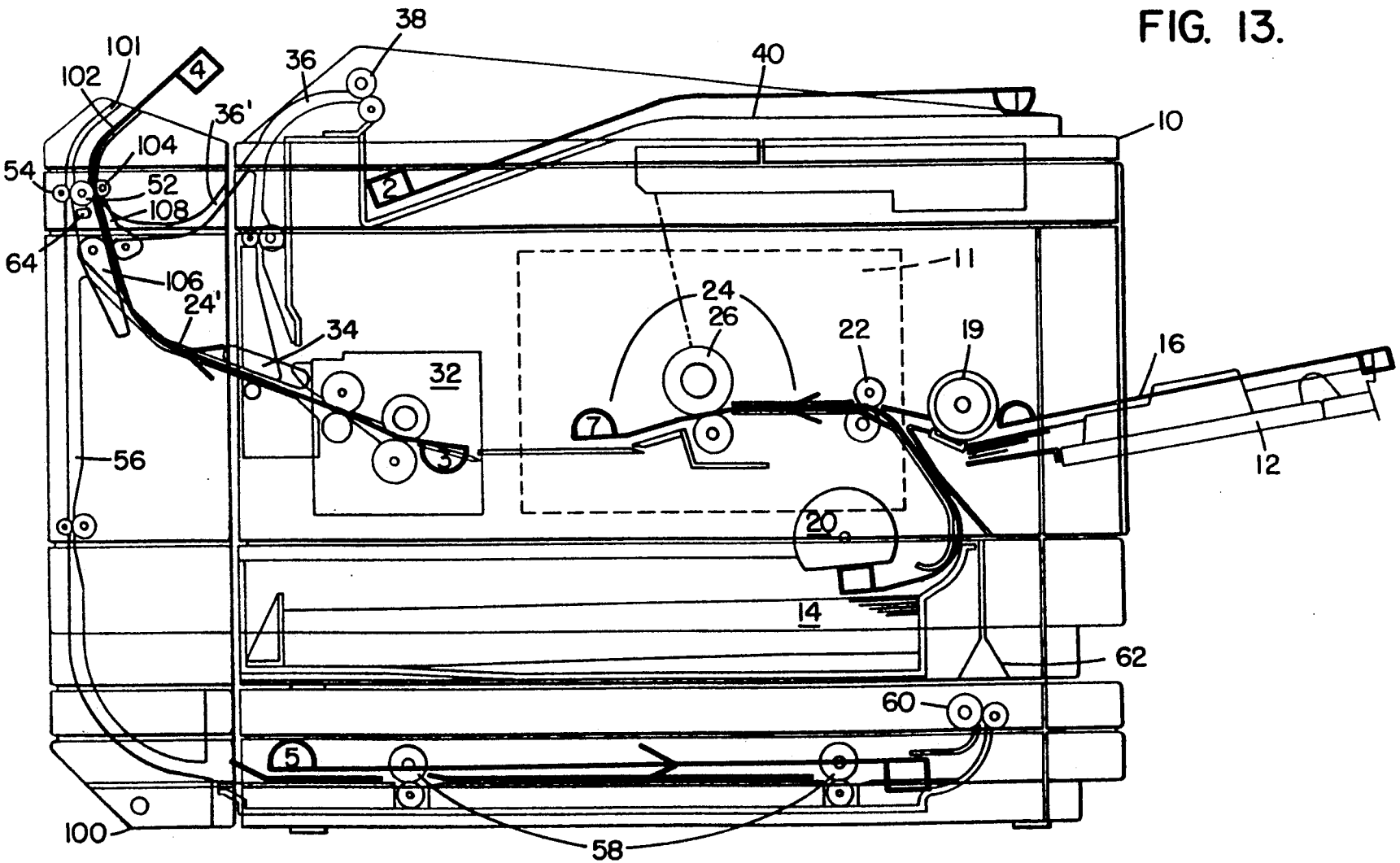
Figure 14:
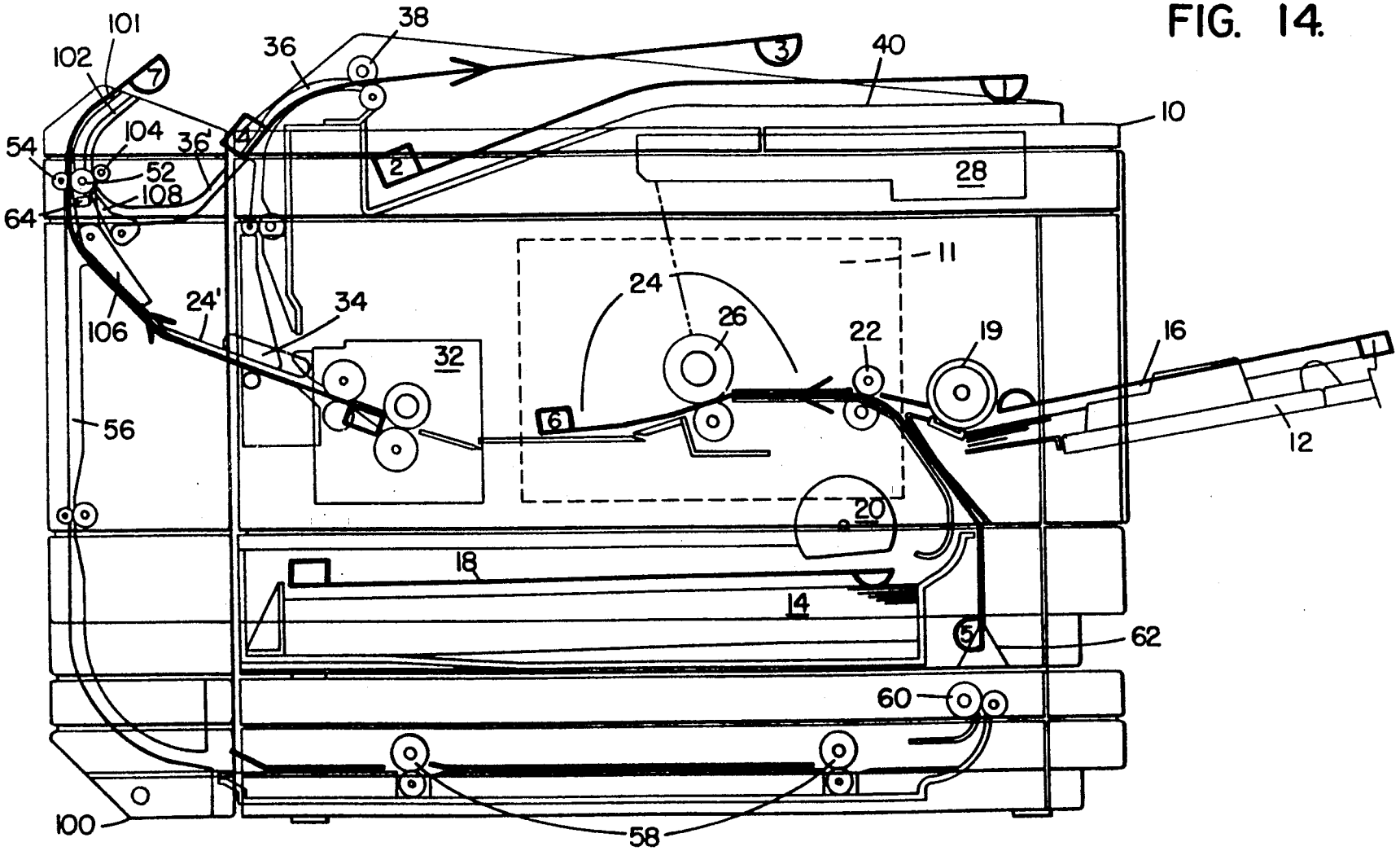

The next snapshot at B3 FIG. 11 shows the media sheet bearing page five has been fed from feed tray 14 and is immediately following the media sheet bearing pages one and two in imprinting path 24. When the end of the media sheet bearing pages one and two is detected by optical sensor 110, reversing roller 52 is switched to clockwise rotation and duplex/output select arm 106 switches to the duplex position, thereby opening communication between path 24' and reversing path 56. Since the end of media sheet bearing page one and two has passed direction changer 108, it is caused, by gravity to rotate in the counterclockwise direction to its original position. Reversing roller 52 thus drives the media sheet bearing pages one and two output path 36' and through output roller 38 to output tray 40 (see FIG. 12, snapshot taken at B4). At this stage, the media sheet bearing page five is also being moved upwardly by reversing roller 52 so that it can then enter reversing path 56 and have page six imprinted thereon. Similarly, the media sheet bearing page three is being fed upwardly from the lower portion of duplexing mechanism 100 via roller 60 and entry aperture 62 into imprinting path 24 (where page four is being printed). FIGS. 13 and 14 show snapshots taken at the times B5 and B6 and further illustrate the sequence of operations of the duplexing mechanism, showing the sequential output of the printed pages.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

I claim:

1. An apparatus for producing images on media sheets in correct page order, wherein said media sheets are identically arranged in supply tray means whether single or double sided image imprinting is to occur, said apparatus including an imprinting path with imprinting means for transferring an image to one side of a media sheet, and a sheet-side reversing path communicating with said imprinting path, said apparatus further comprising:

an output path;

first and second non-intersecting reversing paths communicating with said imprinting path, said first direction reversing path also communicating with said sheet side reversing path and said second direction reversing path also communicating with said output path; and path selection means, operable when said apparatus is to imprint a double-sided image on a media sheet, to direct said media sheet initially to said first direction reversing path after an image has been imprinted on one side of said media sheet, and to direct said media sheet to said second direction reversing path after a second image has been imprinted on a second side of said media sheet, whereby said second direction reversing path enables said media sheet to be directed to said output path.

2. The apparatus as recited in claim 1, wherein said path selection means further comprises:

unitary driving roller means for moving a said sheet in both said first and second direction reversing paths.

3. The apparatus as recited in claim 2 wherein said unitary driving roller means is positioned between said first and second reversing direction paths, each said direction reversing path including a slave roller abutting said unitary driver roller means, whereby rotation of said unitary driving roller means in one direction causes opposite direction movements of sheets positioned between said unitary driving roller means and said slave rollers, respectively, in said first and second direction reversing paths.

4. The apparatus as recited in claim 3 wherein said path selection means further comprises:

a selection arm operable in a first instance to direct a media sheet from said imprinting path to said first direction reversing path and in a second instance, to direct a media sheet from said imprinting path to said second direction reversing path.

5. The apparatus as recited in claim 4, wherein said path selection means further comprises:

an output path selection arm positioned in said second direction reversing path and operable to direct a media sheet from said second direction reversing path to said output path.

6. The apparatus as recited in claim 5, wherein said output path selection arm is gravity operated, whereby a sheet entering said second direction reversing path from said imprinting path pushes said output path selection arm out of the way and when said media sheet passes said output path selection arm, it falls back by the action of gravity across said second direction reversing path and guides said media sheet, after direction reversal, to said output path.

7. The apparatus as recited in claim 6 further comprising:

optical sense means positioned adjacent said first and second direction reversing paths for sensing the passage of the end of a media sheet to enable reversal of rotation of said unitary driving roller means.

8. The apparatus as recited in claim 1 further comprising:

control means for causing sequentially numbered odd pages to be printed first with interspersed even number pages printed immediately after each preceding odd numbered page.

* * * * *